United States Patent [19]

Kralik et al.

[11] Patent Number: 4,492,588

[45] Date of Patent: Jan. 8, 1985

[54] METHOD FOR REMOVING SULFUR FROM FOSSIL FUELS

[75] Inventors: James G. Kralik, Pasadena; William H. Corcoran, San Gabriel, both of Calif.

[73] Assignee: California Institute of Technology, Pasadena, Calif.

[21] Appl. No.: 537,155

[22] Filed: Sep. 29, 1983

Related U.S. Application Data

[63] Continuation of Ser. No. 259,736, May 1, 1981, abandoned.

[51] Int. Cl.[3] ..... C10L 9/06

[52] U.S. Cl. ..... 44/1 R; 44/1 SR; 44/33; 201/17

[58] Field of Search ..... 44/1 R, 1 SR, 27, 33; 201/17

[56] References Cited

U.S. PATENT DOCUMENTS

| | | | |
|---|---|---|---|
| 3,909,211 | 9/1975 | Diaz et al. | 44/1 SR |
| 4,054,420 | 10/1977 | Longanbach | 44/1 SR |
| 4,200,439 | 4/1980 | Lang | 44/1 R |
| 4,204,843 | 5/1980 | Neavel | 44/1 R |
| 4,213,765 | 7/1980 | Wilson | 44/1 SR |
| 4,224,038 | 9/1980 | Masologites et al. | 44/1 SR |
| 4,256,464 | 3/1981 | Ray | 44/1 SR |
| 4,302,207 | 11/1981 | Paspek | 44/1 SR |

FOREIGN PATENT DOCUMENTS

| | | | |
|---|---|---|---|
| 495062 | 9/1976 | Australia | 44/1 SR |
| 2755487 | 6/1978 | Fed. Rep. of Germany | 44/1 SR |

*Primary Examiner*—Carl F. Dees

*Attorney, Agent, or Firm*—Townsend and Townsend

[57] ABSTRACT

A process for removal of sulfur from fossil fuels, such as coal, lignite, peat and fuel oil. The process includes the oxidative treatment of the fuel at or about ambient temperature, followed by a wash with a dilute basic aqueous solution of a basic compound of alkali metal or alkaline earth metal at or about ambient temperature. Upon burning of the fuel, a large amount of the sulfur is trapped as a sulfate in the resulting ash rather than as a gas in the effluent.

55 Claims, 11 Drawing Figures

METHOD FOR REMOVING SULFUR FROM FOSSIL FUELS

This is a continuation of application Ser. No. 259,736, filed May 1, 1981 now abandoned.

BACKGROUND OF THE INVENTION

Coal generally has a sulfur content of 1 to 4 mass percent although it can be as high as 10% for coals mined from seams with large pyrite deposits. Sulfur occurs in two basic forms in coal, either organic or inorganic. The ratio of inorganic to organic sulfur ranges from 4:1 to 1:3 with 2:1 being most common.

The major form of sulfur found in coal is organic. In contrast to inorganic sulfur, organic sulfur is homogeneously distributed throughout the carbonaceous matrix of the coal. Two basic methods exist for the removal of sulfur from coal prior to combustion, namely physical and chemical. Physical desulfurization seeks to separate the sulfur from the coal without altering the sulfur or breaking chemical bonds in the process. The fact that no chemical bonds are broken implies that only the inorganic sulfur forms which, unlike the organic sulfur, are not intimately bound in the carbonaceous matrix can be physically removed. Several methods of physical cleaning of sulfur from coal are currently in use. Although most physical beneficiation methods are relatively inexpensive, only inorganic sulfur forms are removed from the coal. Since current regulations regarding $SO_2$ emissions require 90% sulfur removal for most coals, removal of organic sulfur is necessary as well. Because organic sulfur is covalently bonded to carbon in the coal, processes energetically capable of breaking carbon-sulfur bonds are required.

Reductive desulfurization results in the removal of inorganic and organic sulfur as $H_2S$. The major disadvantages of this process include the high cost of maintaining the high temperature, about 450° C., and pressure, about 2500 psi, required for reaction and the high cost of hydrogen.

On the other hand, oxidative desulfurization schemes seek to remove as much sulfur as possible while minimizing alterations in the rest of the coal structure. This approach is best accomplished by using cheap oxidants under ambient conditions. The selectivity of the oxidant for sulfur with reference to the rest of the coal is of crucial importance to minimize the loss in heating value of the coal. Several oxidative desulfurization schemes have been developed. Most of these attain high inorganic sulfur removal without significant losses in heating value. However, significant organic sulfur removal is usually accompanied by large amounts of oxidation of the carbonaceous material.

In U.S. Pat. No. 3,909,211, the reaction of $NO_2$ and coal in the gas phase has been investigated. The treated coal is washed in water to remove ferric sulfate. Further treatment with aqueous caustic then reduces organic sulfur. For example, this patent teaches the use of a coal containing 3.6% pyrite sulfur and 0.2% organic sulfur, the coal being treated for three hours in a batch reactor at 100° C. with a gaseous mixture containing 5 to 10% $NO_2$. The treated coal is then washed with water followed by a wash with 10% NaOH (aq), leaving a coal with only 0.5% total sulfur content. However, the patent is silent as to the mass and heating value losses of the coal so that no conclusions can be drawn as to the effectiveness of this method in removing sulfur without affecting the coal structure itself.

Because processes which have heretofore been used to remove organic sulfur from fossil fuels have been substantially ineffective without significantly affecting the fuel structure, a need has arisen for an improved process for accomplishing this end, and it is the fulfillment of this need to which the present invention is directed.

SUMMARY OF THE INVENTION

The present invention satisfies the aforesaid need by providing a process which can be performed in a manner to remove a vast amount of organic sulfur from a fossil fuel by first subjecting the fuel to an oxidative treatment with a suitable oxidizing agent at or about ambient temperature and pressure and then subjecting the oxidatively treated coal to a wash with a dilute basic aqueous solution of a compound of an alkali metal or alkaline earth metal for a predetermined period of time at or about ambient temperature and pressure. As a result, there is a relatively uniform uptake of the alkali metal or alkaline earth metal in the fuel due to the oxidative treatment of the fuel so that, upon burning of the fuel, the presence of a basic structure with the alkali metal ion or alkaline earth metal ion traps the organic sulfur, leaving, in solid form in the ash product resulting from the burning, a sulfate whose sulfur would have otherwise been contained in the flue gas resulting from the burning. Only a small amount of organic sulfur leaves by way of the effluent, the vast majority of the sulfur being combined in the solid form in the ash product. Because the processing of coal can be achieved at ambient temperature and pressure, the present method represents a low-cost process for effective desulfurization of a fossil fuel.

The primary object of the present invention is to provide an improved process for desulfurizing fossil fuels of the type containing organic sulfur wherein the process includes the oxidative treatment of the fuel at or about ambient temperature followed by a wash with a dilute basic aqueous solution of a compound of alkali metal or alkaline earth metal at ambient temperature, whereby the process can be carried out with minimum expense and with high efficiency in the removal of sulfur without substantially affecting the heating values of the fossil fuel itself.

Other objects of this invention will become apparent as the following specification progresses, reference being had to the accompanying drawings for an illustration of a reactor used in the method and plots showing test results resulting from the practice of the method.

Figure 3:
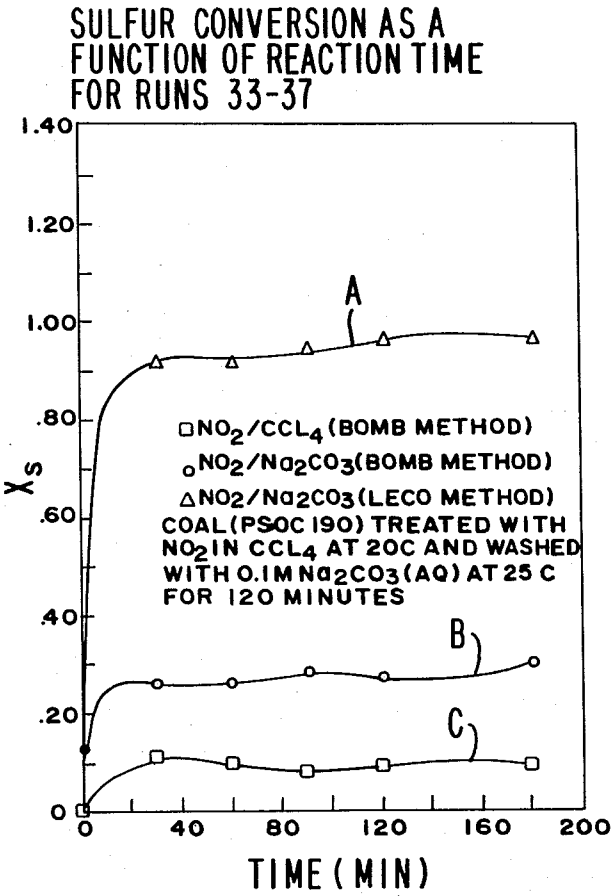
FIG. 3 is a plot of sulfur conversion in the coal as a function of oxidant-exposure time for the specific tests relating to FIG. 1.

The method of the present invention relates to the treatment of a fossil fuel, such as coal, lignite, peat and fuel oil in a manner such that, when the fuel is burned to produce heat energy, substantially all of the organic sulfur inherently residing in the fuel will remain in the ash product resulting from the burning rather than rising with the effluent as a gas and entering the atmosphere as a pollutant. Thus, the harmful effects of the burning of fossil fuels of the type described due to the sulfur content of the fuel is substantially minimized. As a result, some types of fuel, such as coal whose use has heretofore been curtailed or limited because of the sulfur content can now be resumed at an accelerated pace.

The method of the present invention includes the oxidative treating of the fuel with a suitable oxidizing agent, such as $NO_2$, for a predetermined period of time and at ambient temperature and pressure. Prior to this oxidative treatment, the fuel can be treated to minimize or substantially eliminate the inorganic sulfur content of the fuel. This can be accomplished in any one of a number of ways, all of which are well known in the art.

The purpose of this oxidative treatment is the introduction into the fuel of oxygen, either through oxidation of the C-H bonds in the coal or through the uptake of the oxidizer itself. For instance, in the case of coal treated by $NO_2$, the result could be as follows:

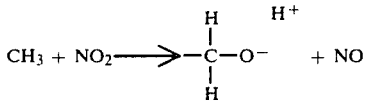

Because up to 25% of the hydrogen content is removed during the oxidative treatment of coal for instance, such oxidation as described above appears to be logical.

After the oxidative treatment, the fuel is filtered to remove the slurrying liquid when used and then dried, following which the fuel is then treated with a dilute basic aqueous solution of a suitable basic compound of alkali metal, such as sodium carbonate, or an alkaline earth metal, such as calcium hydroxide. The fuel remains in this solution for a predetermined period of time at ambient temperature and pressure. Thereafter, the fuel is filtered from the solution and, if desired, can be washed with deionized water to eliminate any water soluble components remaining on the fuel. Then, the fuel is ready to be burned and, upon burning, the ash product resulting from the burning will contain a major portion of the organic sulfur that resided in the fuel before its treatment in accordance with the teachings of the present method. Very small amounts of the organic sulfur passes as a gas with the effluent resulting from the burning so that very little or substantially no scrubbing is required to remove the organic sulfur in the effluent.

To verify the sulfur content in the ash product of the fuel, a sample of the ash can be analyzed with a scanning electron microscope to provide an EDAX spectrum of the elements contained in the ash product. A more detailed description of such a spectrum will be given hereinafter with respect to FIGS. 8–11 as applied to a particular type of coal.

In the oxidative treatment of the fuel with a suitable oxidizer, such as $NO_2$, any of a number of different slurrying liquids can be used, if a slurry is of interest. Carbon tetrachloride is a suitable liquid if $NO_2$ is the oxidizer, because there is no reaction of $NO_2$ with $CCl_4$. The fuel could be treated with an oxidizing gas.

While the exact nature, i.e., anionic, acidic, etc. of the oxygen groups in the treated coal is not fully known, the above mentioned tests as hereinafter described confirm that oxidative treatment of the fuel is necessary for the binding of the alkali metal, such as sodium, or an alkaline earth metal, such as calcium, in the fuel structure. In a specific test, coal which was not subjected to an oxidative treatment and which was washed with a 0.1 M $Na_2CO_3$ (aq) should no significant sodium uptake.

During combustion of the fuel, the basic structure formed in the fuel with the alkali metal or alkaline earth metal traps the acidic gases such as $SO_3$ formed from $SO_2$ evolving in the fuel which would otherwise appear in the effluent resulting from the burning of the fuel. Thus, the fuel, with added alkali metal or alkaline earth metal plus oxygen and heat, results in desulfurized flue gas and an ash with an alkali metal sulfate or alkaline earth metal sulfate in solid form.

In the tests to be described hereinafter, the results show that, upon burning a specific type of coal which had been subjected to an oxidative treatment at ambient temperature and pressure and then washed in an aqueous solution of $Na_2CO_3$ at ambient temperature and pressure, approximately 96% of the organic sulfur was trapped in the ash as $Na_2SO_4$ (s). During combustion, the basic sodium structure forms a flux which traps the $SO_2$ as $Na_2SO_4$, and EDAX spectra, shown in FIGS. 10 and 11 and hereinafter described, provide unequivocal evidence that this is the case. The resulting conclusion from such test is that the oxidant-$Na_2CO_3$ (aq) treatment does not physically remove sulfur from coal; rather, it alters the coal so that a vast portion of the acidic $SO_2$, which would otherwise appear in the flue gas, is effectively trapped in the ash. Thus, organic sulfur ends in a solid phase upon burning of the fuel rather than appearing in the gas phase in the affluent resulting from such burning.

A total of forty-seven tests were conducted to carry out the method of the present invention using PSOC 190 Illinois No. 6 Coal which typically has 16% moisture on a mass basis. The sulfur content of this type of coal is predominantly organic sulfur, about 2.45%, and only a small amount, about 0.10%, of the coal being inorganic sulfur.

Figure 1:
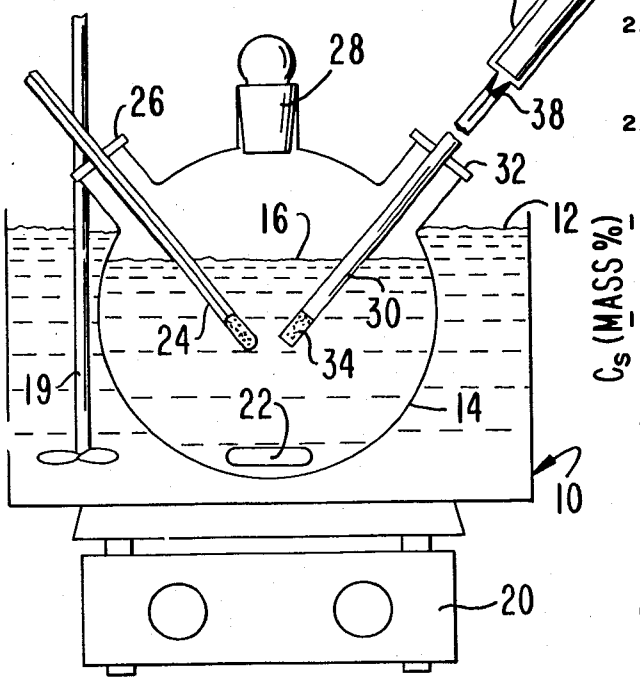
FIG. 1 is a schematic view of a batch reactor used in carrying out the method of the present invention.

A reactor of the type shown in FIG. 1 was used in carrying out the above-mentioned tests. The reactor includes a vessel 10 containing a volume of water to level 12. A flask 14 in the water contains a liquid to a level 16 in the flask. The liquid is $CCl_4$ in which $NO_2$ has been dissolved. The volume of the liquid phase is approximately 350 ml.

A mechanical stirrer 19 is in the water and a magnetic stirrer 20 having a stirring member 22 is associated with the liquid in flask 14. A thermometer 24 is inserted through a stopper 26 into the liquid. A stopper 28 closes the upper opening of the flask. A tube 30 for withdrawing small portions of the liquid extends into the liquid from a stopper 32. A mass of Pyrex wool 34 is in the inner end of tube 30. A glass syringe 36 sealed by a paraffin seal 38 is coupled to the outer end of tube 30 for removing samples of the liquid to monitor the $NO_2$ concentration thereof.

In the tests conducted with reactor 10, the coal was comminuted to 200–325 mesh particle size and, before it was directed into flask 14 for oxidation treatment by the $NO_2$, the coal was washed in water for two hours at ambient temperature. Then the coal was filtered and dried for one week under vacuum at 180° C. The main purpose of this pretreatment was to eliminate as much water as possible from the coal to assure that only $NO_2$ would react with the coal. However, in practice, this pretreatment step is not necessary. The mass loss found to occur in this pretreatment was 12.49%.

After the pretreatment of the coal and after the $NO_2/CCl_4$ solution was placed in flask 14, the coal was directed into flask 14 and into the solution. The temperature of the water in vessel 10 and thereby the temperature of the $NO_2/CCl_4$ system was maintained at approximately 20° C. and the pressure was atmospheric. The coal was left in the $NO_2/CCl_4$ system for a predetermined period of time for each test run. For the test runs whose results are shown graphically in FIGS. 2–10, the time periods of the coal in this system for five different tests were 30 mins., 60 mins., 90 mins., 120 mins., and 180 mins.

After the predetermined time interval of the coal in the treating system for each test run, the coal was vacuum filtered as quickly as possible from the solution and quickly transferred to a vacuum rack for drying and to keep the uptake of water at a minimum. Vacuum drying occurred for approximately three hours at 110° to 120° C. At the end of this time, the coal was weighed for mass loss.

In the next step of the method of the present invention, 5 grams of the oxidant-treated coal from flask 14 was put into a flask of a second reactor similar to the reactor 10, the flask containing 250 ml of 0.1 M $Na_2CO_3$ at ambient temperature and pressure. The coal was subjected to this solution for approximately two hours. After this time period, the coal was filtered from the $Na_2CO_3$ solution. The filter cake resulting from this filtering step was mixed with 100 ml of fresh, deionized water and filtered again. The mixing of the filter cake with the deionized water and the filtering was repeated five more times to eliminate any water soluble components from the coal. After the final filtering step, the coal was again weighed for a mass loss and was thereafter ready for burning.

Figure 8:
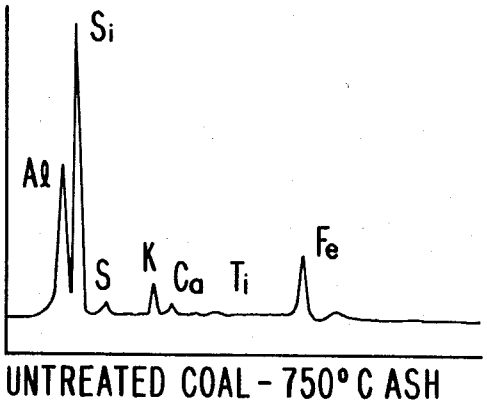
FIG. 8 is a photograph of an EDAX spectrum of the ash from the burning of PSOC 190, Illinois No. 6 Coal when the coal was burned at 750° C. and the coal was untreated.
Figure 9:
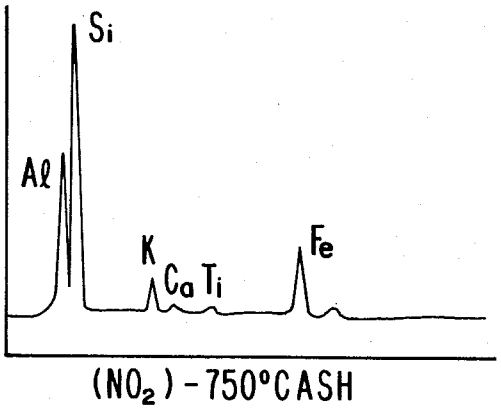
FIG. 9 is a view similar to FIG. 8 but showing the EDAX spectrum for $NO_2$-treated coal without treatment with an alkali metal or an alkaline earth metal with the coal being burned at 750° C.
Figure 10:
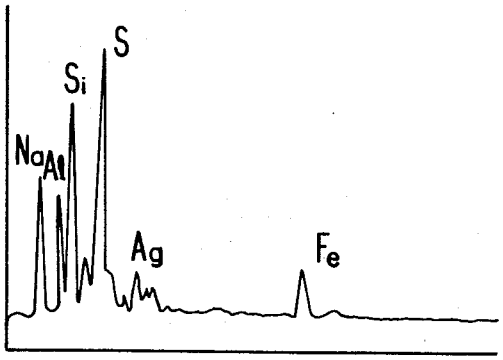
FIG. 10 is a plot similar to FIGS. 8 and 9 but showing coal treated with $NO_2$ and aqueous solution $Na_2CO_3$ and burned at 750° C.
Figure 11:
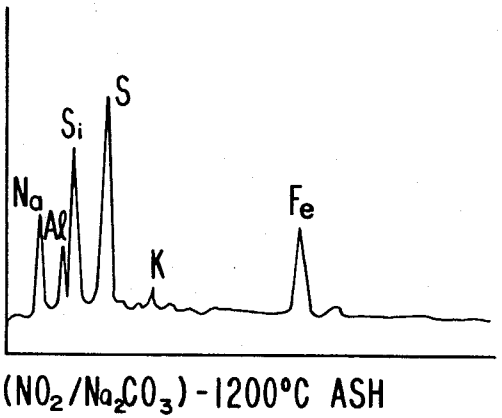
FIG. 11 is a plot similar to FIGS. 8–10 but showing the EDAX spectrum for coal treated with $NO_2$ and an aqueous solution of $Na_2CO_3$ and burned at 1200° C.

The coal was then burned and the resulting ash was collected. Samples of the ash from a member of the test runs were analyzed with a scanning electron microscope to obtain EDAX spectra of the ash. FIGS. 10 and 11 show the EDAX spectra of coal ash when the coal was burned at 750° C. and 1200° C., respectively. By comparison, FIG. 8 shows the EDAX spectra taken from the ash of untreated coal, and FIG. 9 shows the EDAX spectra obtained from the ash of coal treated only with $NO_2$ but not with the $Na_2CO_3$ wash. FIGS. 10 and 11 unequivocally show that the ash contains a large portion of sulfur and this has been determined to be at least 96% of the organic sulfur inherent in the coal before treatment.

Figure 2:
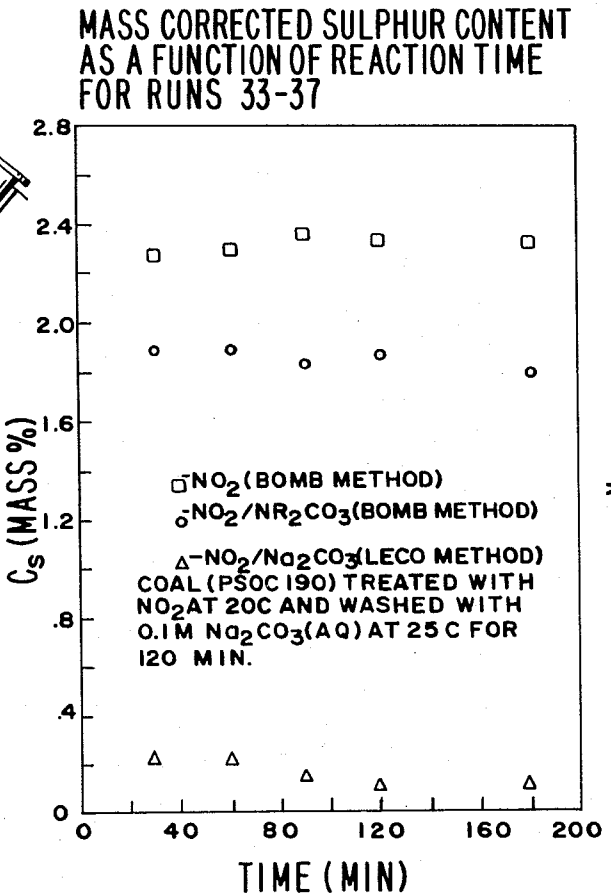
FIG. 2 is a plot of mass-corrected sulfur content of a certain type of coal as a function of various oxidant exposure times obtained in a number of specific tests of the method of the present invention. The term "mass corrected" means that the sulfur content has been corrected for the amount of absorbed $CCl_4$.

FIG. 2 shows the sulfur content, as corrected for the mass, as a function of the oxidant-exposure time for the 30, 60, 90, 120, and 180-minute-time intervals for the five tests described herein. The bomb method was used in determining the sulfur content for $NO_2$-treated coal without treatment with $Na_2CO_3$. The bomb method was also used to determine the sulfur in the $NO_2/Na_2CO_3$ treated coal. The Leco method was used to determine the content of the sulfur in the flue gas resulting from the burning of the coal. The differences in the sulfur content for the five test runs using the bomb and Leco methods purely illustrate that a major portion, such as 96%, of the organic sulfur does not leave as flue gas from burned coal but resides in the ash product resulting from the burning of the coal. FIG. 3 illustrates in more graphic detail the above results mentioned with respect to FIG. 2. Curve A of FIG. 3 shows the removal of $SO_2$ coming off washed coal during combustion. As can be seen, a total of about 96% of the sulfur for all test runs is removed during combustion. Typical removal of approximately 30% of the original sulfur by the $Na_2CO_3$ wash of the oxidant-treated coal is indicated by curve B. Curve C indicates that 10% of the initial sulfur in the coal is physically removed by treatment with the oxidant.

Figure 4:
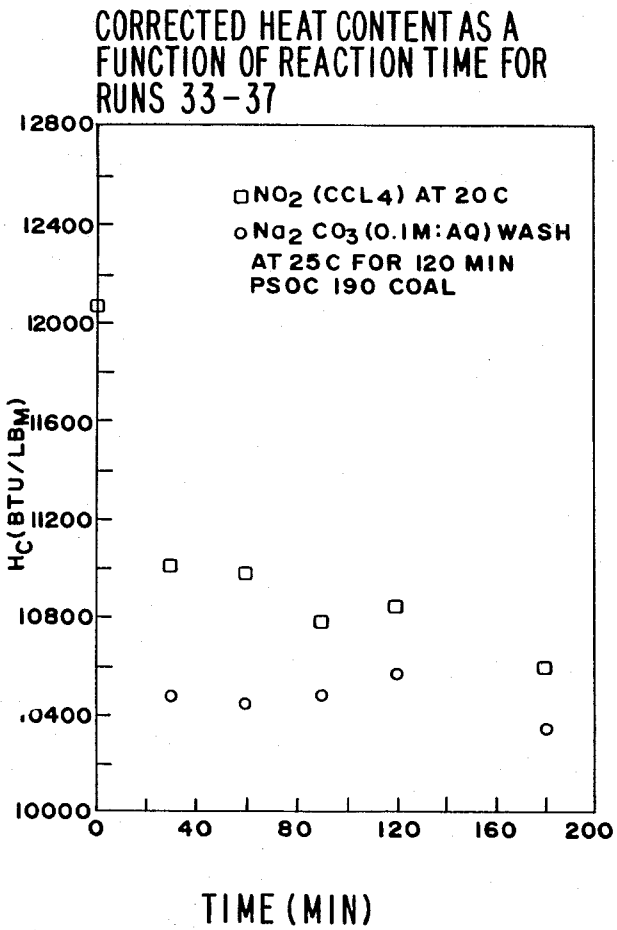
FIG. 4 is a plot of corrected heat content of the coal as a function of oxidant-exposure time for the specific tests relating to FIGS. 2 and 3.

The corrected heat content of the coal before it is burned as a function of reaction time is shown in FIG. 4. The coal is shown to have lost some of its heat content by oxidative treatment. As can be seen from this plot, the heat content of the oxidant-treated coal after exposure to the $Na_2CO_3$ (aq) solution is slightly less than the heat content of the coal resulting from only an oxidative treatment. The heat-content loss was found to occur in the first 30 minutes of treatment and was found not to be substantially dependent on temperature of the oxidant system or the $NaCO_3$ wash.

Figure 5:
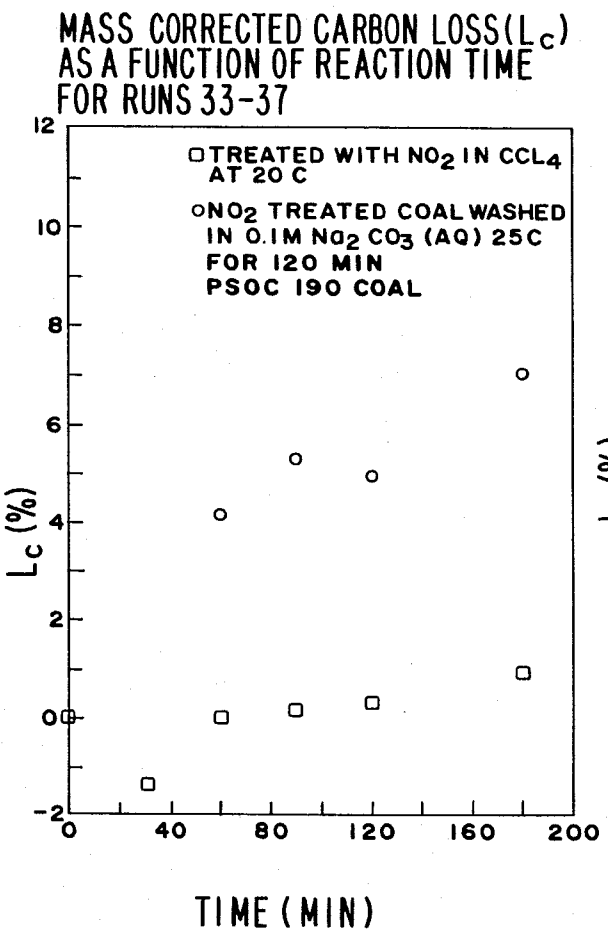
FIG. 5 is a plot of mass-corrected carbon loss in the coal as a function of oxidant-exposure time for the specified tests.

The mass corrected carbon loss as a function of reaction time is shown in FIG. 5. This plot shows that there is an increase in the carbon loss of about 4 to 7% of the oxidant-$Na_2CO_3$ (aq) treated coal; whereas, there is substantially no carbon loss with coal treated only with the oxidant.

Figure 6:
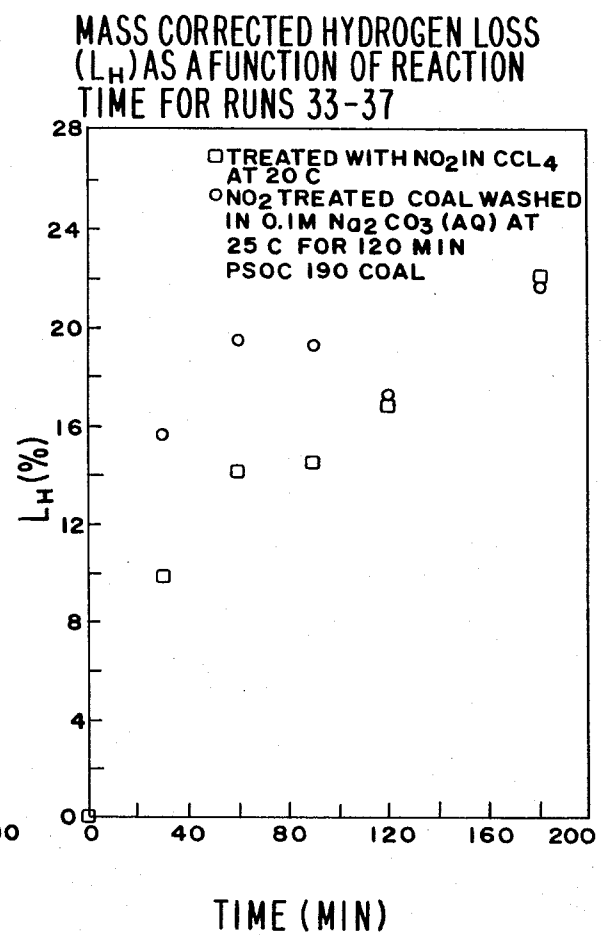
FIG. 6 is a plot of mass-corrected hydrogen loss of the coal as a function of oxidant-exposure time for the specified tests.

The mass-corrected hydrogen loss as a function of reaction time is shown in FIG. 6 in which losses in the range of 16 to 22% were found in the oxidant-$Na_2CO_3$ (aq) treated coal. This result was to be contrasted with hydrogen losses of 8 to 22% in the coal treated only with the oxidant.

Figure 7:
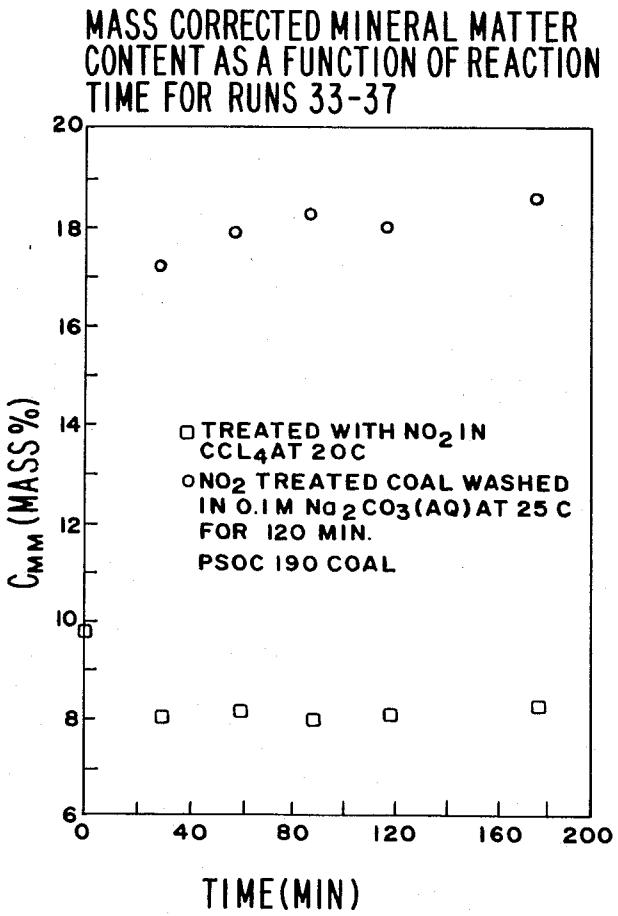
FIG. 7 is a plot of mass-corrected mineral matter content of the coal as a function of oxidant-exposure time for the specified tests.

FIG. 7 shows the mass corrected mineral matter content of the coal as a function of oxidant exposure time. On the basis of the trends displayed by the mineral matter content during the course of treatment, a mechanism for the ultimate uptake of sodium can be proposed. The exposure of the coal to the oxidant results in the loss of roughly 20% of the original hydrogen content in the coal as well as the uptake of the oxidant by the coal. Thus, a large number of anionic oxygen atoms are introduced into the coal where the hydrogen is either removed or remains in cationic form. Exposure of the oxidant-treated coal to the $Na_2CO_3$ (aq) solution results in the exchange of the cationic hydrogen with sodium which provides a stable, distributed precursor for the sulfur-bearing salt in the ash.

Therefore, treatment of the coal with an oxidant under ambient conditions establishes an ion-exchange characteristic in the coal. In particular, anionic oxygen atoms are introduced into the coal which bind to cationic hydrogen. Exposure of the oxidant-treated coal to an aqueous solution of a basic compound of an alkali or alkaline earth metal provides a stable, distributed precursor formed by the exchange of the cationic metal with the cationic hydrogen. The formation of this precursor occurs without a substantial loss in the heating value of the coal. The sulfur is not physically removed from the coal. Rather, upon combustion of the fuel, a large amount of the sulfur is trapped as a sulfate salt in the resulting ash instead of evolving as $SO_2$ in the combustion gas. In particular, it is the precursor which is responsible for the trapping of sulfur in the ash.

What is claimed is:

1. In a process for preparing a sulfur-containing fossil fuel for combustion: forming a basic and distributed precursor by subjecting the fuel for combustion to an oxidative treatment at approximately ambient temperature; and subjecting the oxidant-treated fuel to a basic aqueous solution of a compound of an alkali metal or an alkaline earth metal without substantially removing the sulfur from the fuel, whereby, upon combustion of the fuel, a major portion of the sulfur in the fuel will be trapped in the reaction with the precursor and appear in the resulting ash as a sulfate.

2. In a process as set forth in claim 1, wherein is included the step of burning the fuel to extract the heating value therefrom.

3. In a process as set forth in claim 1, wherein said fuel is coal.

4. In a process as set forth in claim 1, wherein said fuel is lignite.

5. In a process as set forth in claim 1, wherein said fuel is peat.

6. In a process as set forth in claim 1, wherein said fuel has an organic sulfur content and an inorganic sulfur content.

7. In a process as set forth in claim 1, wherein said step of subjecting the fuel to an oxidative treatment includes slurrying the fuel in a suspending liquid containing an oxidizing agent and retaining the fuel in said slurry for a sufficient time period to allow for the introduction of a sufficient amount of anionic oxygen which binds to a sufficient amount of ions of metals from the alkali metal or alkaline earth metal to trap the sulfur in the fuel upon combustion.

8. In a process as set forth in claim 7, wherein said fuel is coal.

9. In a process as set forth in claim 7, wherein said fuel is lignite.

10. In a process as set forth in claim 7, wherein said fuel is peat.

11. In a process as set forth in claim 7, wherein the oxidizing agent includes $NO_2$.

12. In a process as set forth in claim 7, wherein the suspending liquid includes $CCl_4$.

13. In a process as set forth in claim 12, wherein the liquid phase includes $CCl_4$ that is 1.1 formal in $NO_2$.

14. In a process as set forth in claim 7, wherein the suspending liquid includes water.

15. In a process as set forth in claim 7, wherein is included the step of separating the fuel from said suspending liquid after said time-interval and before subjecting the fuel to said basic aqueous solution.

16. In a process as set forth in claim 1, wherein said step of subjecting the fuel to an oxidative treatment includes mixing the fuel with a fluid containing an oxidizing agent, and sustaining the mixture for a sufficient time period to allow for the introduction of a sufficient amount of anionic oxygen which binds to a sufficient amount of ions of metals from the alkali metal or alkaline earth metal to trap the sulfur in the fuel upon combustion.

17. In a process as set forth in claim 16, wherein said fuel is coal.

18. In a process as set forth in claim 16, wherein said fuel is lignite.

19. In a process as set forth in claim 16, wherein said fuel is peat.

20. In a process as set forth in claim 1, wherein the fuel is subjected to said oxidative treatment for a time interval in the range of 5 minutes to 180 minutes.

21. In a process as set forth in claim 1, wherein said basic aqueous solution includes a 0.1 M $Na_2CO_3$ solution.

22. In a process as set forth in claim 1, wherein said step of subjecting the fuel to an oxidative treatment includes forming an ion-exchange structure in the hydrogen-ion mode.

23. In a process as set forth in claim 22, wherein the fuel is coal.

24. In a process as set forth in claim 22, wherein the fuel is lignite.

25. In a process as set forth in claim 22, wherein the fuel is peat.

26. A process of preparing a sulfur-containing fossil fuel for combustion comprising: forming a basic and distributed precursor by subjecting the fuel to an oxidizing agent for a first time-interval to provide an oxidative treatment of the fuel; and thereafter mixing the fuel with a basic aqueous solution of a compound of a metal selected from the group including alkali metals and alkaline earth metals; maintaining the system for a second-time-interval without substantially removing the sulfur from the fuel and without substantially reducing the heating value of the fuel; and removing the fuel from said system, whereby a major portion of the sulfur in the fuel, when the fuel is burned, will be trapped as a sulfate in the ash.

27. A process as set forth in claim 26, wherein said oxidizing agent includes $NO_2$.

28. A process as set forth in claim 26, wherein said metal includes sodium.

29. A process as set forth in claim 26, wherein said compound includes $Na_2CO_3$.

30. A process as set forth in claim 26, wherein the step of subjecting the fuel to said oxidizing agent is performed at approximately ambient temperature.

31. A process as set forth in claim 26, wherein the step of subjecting the fuel to said oxidizing agent is performed at approximately ambient temperature and atmospheric pressure.

32. A process as set forth in claim 26, wherein the solution is at approximately ambient temperature during said second time-interval.

33. A process as set forth in claim 26, wherein the solution is at approximately ambient temperature and atmospheric pressure during said second time-interval.

34. A process as set forth in claim 26, wherein the step of subjecting the fuel to an oxidizing agent includes direction $NO_2$ gas into contact with the fuel.

35. A process as set forth in claim 26, wherein the step of subjecting the fuel to an oxidizing agent includes directing the fuel into a fluid containing said oxidizing agent.

36. A process as set forth in claim 35, wherein said oxidizing agent includes $NO_2$.

37. A process as set forth in claim 35, wherein is included the step of separating the fuel from the fluid after said first time-interval and before said directing step.

38. A process as set forth in claim 26, wherein the first time-interval is in the range of 5 to 180 minutes.

39. A process as set forth in claim 26, wherein the second time-interval is in the range of 5 minutes to 3 hours.

40. A process as set forth in claim 26, wherein the fuel has an organic sulfur content and an inorganic sulfur content.

41. A process as set forth in claim 26, wherein the fuel is coal.

42. A process as set forth in claim 26, wherein the fuel is lignite.

43. A process as set forth in claim 26, wherein the fuel is peat.

44. A process as set forth in claim 26, wherein the step of subjecting the fuel to an oxidizing agent includes forming an ion-exchange structure in the hydrogen-ion mode.

45. In a process as set forth in claim 44, wherein said fuel is coal.

46. In a process as set forth in claim 44, wherein said fuel is lignite.

47. In a process as set forth in claim 44, wherein said fuel is peat.

48. In a process as set forth in claim 26, wherein is included the step of removing the inorganic sulfur from the fuel before said step of forming the precursor.

49. An oxidatively treated fuel product comprising a sulfur-containing fuel exposed to an aqueous solution of a compound of a metal selected from the group including alkali metals and alkaline earth metals to form a basic and distributed precursor whereby a major portion of the sulfur in the fuel, when the fuel is burned, will be trapped as a sulfate in the ash.

50. A fossil fuel treated by the process of any of claims 1, 7, 11, 16, 20–22, 26–39, 44 and 49.

51. A treated coal produced by first oxidizing a coal to introduce cationic hydrogen and thereafter exposing the coal to an aqueous salt selected from the group including an alkali metal and an alkaline-earth metal for a sufficient time period to substitute said aqueous salt for said cationic hydrogen.

52. A treated coal as in claim 51, wherein said coal is oxidized by first comminuting the coal and then treating the coal in a mixture of nitrogen dioxide dissolved in carbon tetrachloride at approximately ambient conditions for a period of time sufficient to introduce cationic hydrogen in place of at least 20% of the hydrogen initially present.

53. A treated coal as in claim 51, wherein the time period is at least 30 minutes.

54. A treated coal as in claim 51, wherein said aqueous salt is present at a concentration of about 0.1M.

55. A treated coal as in claim 51, wherein said time period is about 2 hours.

* * * * *